United States Patent [19]

Subramanyan et al.

[11] 4,076,597

[45] Feb. 28, 1978

[54] METHOD OF FORMING IRON FOIL AT HIGH CURRENT DENSITIES

[75] Inventors: Palliyil K. Subramanyan, Shaker Heights; Mieczyslaw Paul Makowski, Wickliffe; Robert Joseph Setele, Eastlake, all of Ohio

[73] Assignee: Gould Inc., Rolling Meadows, Ill.

[21] Appl. No.: 747,719

[22] Filed: Dec. 6, 1976

[51] Int. Cl.[2] ..... C25D 1/04; C25D 3/20

[52] U.S. Cl. ..... 204/13; 204/48

[58] Field of Search ..... 204/13, 48

[56] References Cited

U.S. PATENT DOCUMENTS

| | | | |
|---|---|---|---|
| 1,878,540 | 9/1932 | Reinhardt et al. | 204/13 |
| 2,128,389 | 8/1938 | Young et al. | 204/13 |
| 2,944,954 | 7/1960 | Yeck | 204/13 |
| 3,817,843 | 6/1974 | Barrett | 204/13 |

FOREIGN PATENT DOCUMENTS

| | | | |
|---|---|---|---|
| 1,117,642 | 6/1968 | United Kingdom | 204/13 |

*Primary Examiner*—T. M. Tufariello

*Attorney, Agent, or Firm*—Russell E. Baumann

[57] ABSTRACT

A method of electrolytically producing a sheet of iron foil is provided which utilizes a rotating drum cathode and a spaced apart anode. The anode is fashioned from an iron containing material which is capable of producing iron ions that are soluble in the ferrous chloride electrolyte.

5 Claims, 1 Drawing Figure

METHOD OF FORMING IRON FOIL AT HIGH CURRENT DENSITIES

BACKGROUND OF THE INVENTION

This invention relates to an improved method of electrolytically depositing iron foil on a rotating cathode.

It is known to produce iron foil on a rotating cathode by the electrolysis of a suitable electrolyte. See for example U.S. Pat. No. 3,817,843. In this patent, a technique for the electrodeposition of iron foil is disclosed which concerns the use of a rotating cathode and nonconsumable anode.

While the technique described in the above-referred to patent is suitable for producing iron foil, the foil soproduced does not evidence optimum physical properties. For example, it is subject to hydrogen embrittlement due to the low pH requirements inherent in the described process. In addition, due to the low current density employed the rate of foil deposition is exceptionally slow from a commercial standpoint.

Accordingly, it is the principle object of this invention to provide an improved method for electrolytically depositing iron foil on a rotating cathode.

Other objects of the invention will become apparent to those skilled in the art from a reading of the specification and claims.

SUMMARY OF THE INVENTION

Broadly, the present invention concerns an improved method of electrodepositing iron foil on a rotating drum cathode by use of an iron containing anode which, under the action of an applied electrical current, is capable of producing iron ions that are soluble in the electrolyte.

More specifically, a method of electrolytically producing a sheet of iron foil on a rotating drum cathode is provided which comprises the steps of providing an iron containing anode spaced apart from a rotatably mounted drum cathode so as to form a gap between the cathode and the anode for containing electrolyte, the anode being capable of forming iron ions which are soluble in said electrolyte; flowing an aqueous ferrous chloride containing electrolyte between said cathode and said anode at a rate ranging from about 2 to about 10 feet per second, said electrolyte containing from about 120 to about 162 grams/liter of ferrous ions; maintaining the pH of said electrolyte in the range of from about 3.3 to about 4.7; heating said electrolyte to a temperature in excess of ambient but below its boiling point; rotating said cathode through said electrolyte; passing direct electrical current between said cathode and anode at a cathode current density ranging from about 800 to about 3600 amperes per square foot to cause iron to be deposited on said cathode; and removing said so-formed iron foil from said cathode.

DESCRIPTION OF THE DRAWING

The drawing is a diagrammatic illustration, in cross-section, of an apparatus used in the practice of the present invention.

Referring now to the drawing wherein the showings are for the purpose of illustrating the invention and not for the purpose of limiting the same, there is generally shown a rotating cathode electroplating apparatus used in the practice of the instant invention.

Figure 1:
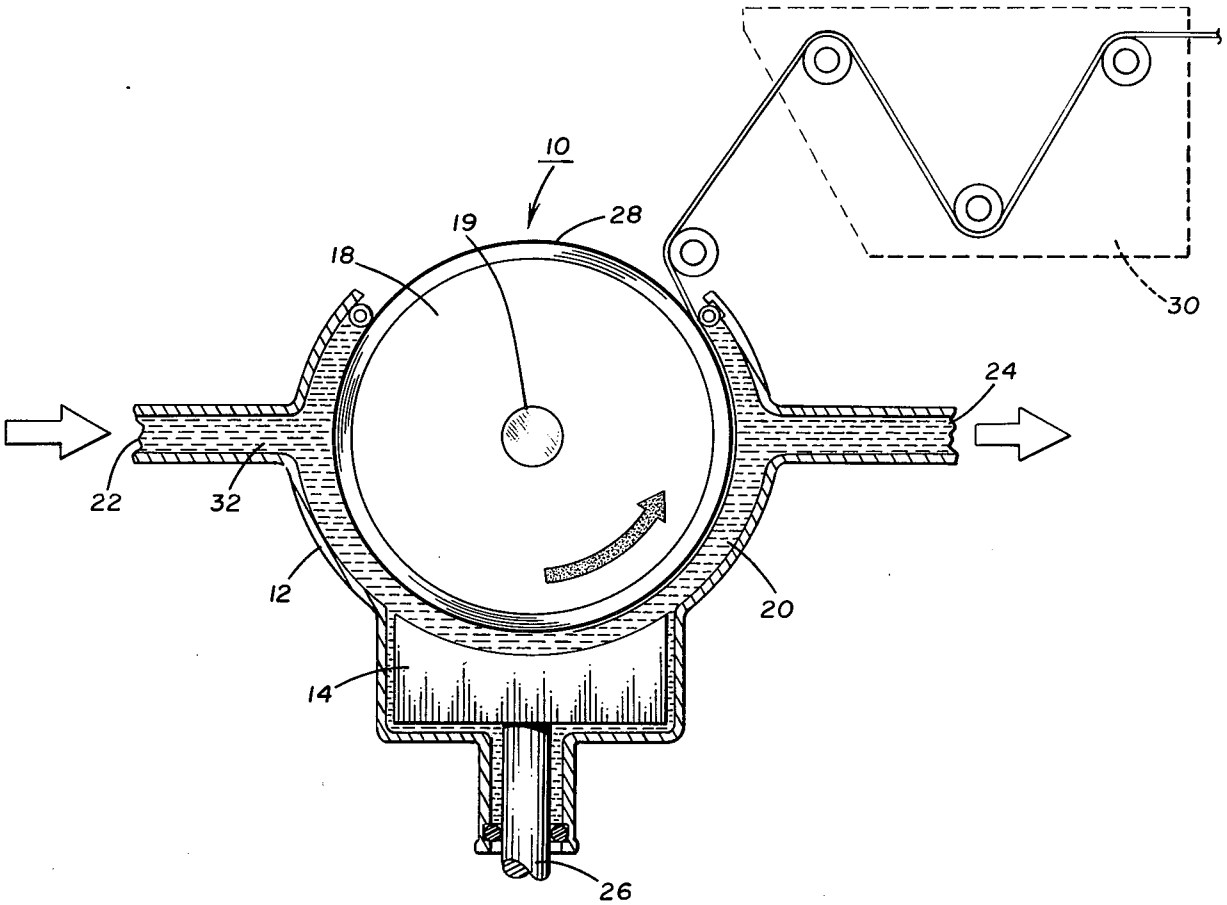

Specifically, an electroplating apparatus is shown which is generally designated by the numeral 10. This apparatus includes a housing or shell 12 having a cavity 14 therein for receiving anode 16. A drum cathode 18, which is rotatably mounted to about shaft 19, is positioned in a spaced apart relationship with the anode 16 so as to form a gap or channel 20 therebetween. The cathode is usually cylindrical in shape. Electrolyte 32 is introduced into gap 20 through inlet 22. In operation, at least a part of the surface of the rotating cathode is submerged in the electrolyte to provide a conductive path between the anode and the cathode. The electrolyte is flowed between the anode and cathode at the desired rate and removed from the gap 20 by means of outlet 24. The cathode is connected to a negative source of direct electrical current (not shown). Likewise the anode is connected to a positive source of direct electrical current (not shown). The spacing or distance between the cathode and the anode is controlled by anode adjusting means 26. It is preferred to keep the spacing between the rotating cathode and the anode constant so that the electrodeposition of the iron foil can be closely controlled.

When electric current is caused to flow between the anode and cathode and electrolyte is caused to flow through the cell, iron foil is deposited on the surface 28 of the rotating cathode. The so-deposited foil is then removed therefrom by any suitable means, generally through a rinse and a drying stage and a wind-up means collectively designated as 30.

The various components of the electroplating apparatus described above can be fashioned from any suitable material. In practice, it has been found most desirable to fabricate the surface of the cathode from titanium or a titanium base alloy. The anode is preferably composed of a conventional iron base material such as 1018 mild steel .

The foregoing description of apparatus suitable for the practice of the instant invention is given for illustrative purposes only. Obviously various modifications may be made thereto for the purpose of operating the same.

DESCRIPTION OF THE PREFERRED EMBODIMENTS OF THE INVENTION

In the practice of the present invention, the electrolyte utilized is an aqueous solution of ferrous chloride. It has been discovered that in order to obtain optimum conductivity the concentration of ferrous ions in solution should range from about 120 up to slightly less than about 162 grams/liter. Use of at least 120 grams/liter of ferrous ion provides ideal electrolyte conductivity. This conductivity then remains essentially constant at concentrations of up to about 162 grams per liter of ferrous ions. After reaching this point, the electrolyte conductivity decreases. In addition, iron foil produced at concentrations in the range of about 162 grams/liter of ferrous ions to about 182 grams per liter of ferrous ions are generally very brittle. Accordingly, it is critical that the concentration of ferrous chloride range from about 120 to slightly less than about 162 grams/liter. While the foregoing sets forth the desired range of ferrous ion concentration, it has been observed that iron foil produced by using an electrolyte containing about 120 to about 150 grams/liter of ferrous ions (as $FeCl_2$) exhibits better ductility. Accordingly, if foil having high ductility is desired, the maximum concentration of ferrous ions in the electrolyte should not exceed about 150 grams per liter.

The pH of the electrolyte is adjusted so as to keep the ferrous ions in solution. In practice, the electrolyte is preferably maintained at a pH ranging from about 3.3 to about 4.7. By operating in the foregoing range hydrogen ion concentration in the electrolyte is decreased and minimum amounts of hydrogen are deposited on the cathode thereby avoiding a major source of foil embrittlement.

During plating, the electrolyte is heated above ambient temperatures to increase its conductivity, to disperse stress in the deposit and also to improve ductility. Preferably, it is maintained at a temperature approaching its boiling point. With ferrous chloride containing electrolytes of the above-described type, it is common to plate with the electrolyte having a temperature ranging from about 100° C to about 105° C. However, iron foil can be deposited at temperatures ranging from about 85° C. to the boiling point of the electrolyte.

In operation, the electrolyte is caused to flow between the cathode and the anode at a flow velocity ranging from about 2 to 3 feet per second to about 10 feet per second. In general, the lower flow rates are utilized when low current densities are employed. However, all that is required is that sufficient electrolyte be provided between the anode and cathode during the plating procedure to provide the desired amount of ferrous ions.

In practice, the desired iron foil is produced by utilizing an apparatus of the type generally shown in the drawing by operating at a cathode current density ranging from about 800 to 3600 amps per square foot. The so-produced iron foil is free from stress and pits and is easily removed from the cathode. By operating within the recited current density range, it is possible to rapidly obtain suitable iron deposits.

The cathode is rotated at any suitable rate. The exact amount of rotations is determined empirically. Obviously, it should not be rotated in such a fashion that iron is deposited in a discontinuous or uneven manner.

The following are examples of the practice of the instant invention. The apparatus utilized is of a general type shown in the drawing. The cathode was a 12 by 24 inches cylindrical drum having a titanium surface. However, for test purposes a plating area of 6 by 6 inches in the middle of the drum was used. The anode was fashioned from 1018 mild steel. The cathode was rotated at a rate of from 0.02 to 1.0 rpm. Deposits ranging from 0.75 to 10 mils thick were produced.

EXAMPLE 1

A bath consisting of 300.0 grams/liter of $FeCl_2$ (132.0 grams/liter ferrous ions) prepared. The pH of the solution was adjusted to within the range of about 3.15 to 4.4. The solution was heated to about 101° C. The electrolyte was caused to flow between the anode and cathode at a rate of about 4 feet per second. The drum was rotated at a rate of 0.02 rpm. Electric current was passed between the anode and cathode so that a current density of aobut 800 asf was achieved. About 17 feet of foil was produced. The thickness of the foil was about 10.2 mils. The so-produced foil was continuously removed from the drum in the conventional manner. Select specimens thereof were metallographically evaluated and it was found that the resultant iron foil was essentially (99.9%) pure, stress free and highly ductile (6%).

EXAMPLE 2

A bath consisting of 302.0 grams/liter of $FeCl_2$ (133.0 grams/liter ferrous ions) was prepared. The pH of the solution was adjusted to within the range of about 3.35 to 4.7. The solution was heated to about 98 to 106° C. The electrolyte was caused to flow between the anode and cathode at a rate of about 10.0 feet per second. The drum was rotated at a rate of 0.072 to 0.27 rpm. Electric current was passed between the anode and cathode so that a current density of from about 800 to 3000 asf was achieved. The specific current densities utilized were 800 asf, 1000 asf, 1200 asf, 1600 asf, 2000 asf, 2400 asf, 2800 asf and 3000 asf. The foil produced at each current density was about 10 to 15 feet in length. A total of about 155 feet of foil was produced. The thickness of the foil was about 2.0 mils. The so-produced foil was continuously removed from the drum in the conventional manner. Select specimens thereof were metallographically evaluated and it was found that the resultant iron foil was essentially pure, stress free and highly ductile.

EXAMPLE 3

A bath consisting of 320.0 grams/liter of $FeCl_2$ (141.0 grams/liter ferrous ions) was prepared. The pH of the solution was adjusted to within the range of about 4.55 to 4.67. The solution was heated to about 101° to 104° C. The electrolyte was caused to flow between the anode and cathode at a rate of about 10.0 feet per second. The drum was rotated at a rate of 0.15 to 0.4 rpm. Electric current was passed between the anode and cathode so that a current density of about 1200 to 3200 asf was achieved. About 60 feet of foil was produced with about 20 feet of foil being deposited at 3200 asf. The thickness of the foil was about 1.2 mils. The so-produced foil was continuously removed from the drum in the conventional manner. Select specimens thereof were metallographically evaluated and it was found that the resultant iron foil was essentially pure, stress free and highly ductile.

From the foregoing, it is to be noted that for the first time a process has been provided for producing sound, ductile iron foil at high current densities with both the cathode and anode evidencing an electrochemical efficiency of about 100 percent. These results were obtained by carefully controlling the chemical composition of the electrolyte, its pH, temperature and the current density.

While there have been described what are at present considered to be the preferred embodiments of this invention, it will be obvious to those skilled in the art that various changes and modifications may be made therein without departing from the invention, and it is, therefore, aimed in the appended claims to cover all such changes and modifications as fall within the true spirit and scope of the invention.

What is claimed is:

1. A method of electrolytically producing a sheet of iron foil on a rotating drum cathode comprising the steps of:

providing an iron containing anode spaced apart from a rotatably mounted drum cathode so as to form a gap between said cathode and said anode for containing electrolyte, said anode being capable of forming iron ions which are soluble in said electrolyte;

flowing electrolyte between said cathode and said anode while maintaining the concentration of ferrous ion in said electrolyte within the range of from about 120 to less than about 162 grams per liter;

maintaining the pH of said electrolyte at a value ranging from about 3.3 to about 4.7 to prevent said ferrous ions from precipitating;

heating said electrolyte to a temperature in excess of ambient but below its boiling point;

rotating at least a portion of said cathode through said electrolyte;

passing direct electrical current between said cathode and anode at a cathode current density of at least about 800 amperes per square foot to cause iron to be deposited on said cathode; and removing said so-formed iron foil from said cathode.

2. The method of claim 1 wherein said electrolyte is flowed between said anode and said cathode at a flow rate of from about 2 to about 10 feet per second.

3. The method of claim 1 wherein said electrolyte is heated to a temperature ranging from about 100° to about 105° C.

4. The method of claim 1 wherein said current density ranges from about 800 to about 3600 amperes per square foot.

5. The method of claim 1 wherein said electrolyte contains from about 120 to about 150 grams per liter of ferrous ions.

* * * * *